US007581261B2

(12) United States Patent
Cho

(10) Patent No.: US 7,581,261 B2
(45) Date of Patent: Sep. 1, 2009

(54) HEADGEAR WITH SIZE ACCOMMODATION IN THE FRONT

(75) Inventor: Byoung-Woo Cho, Kyungki-do (KR)

(73) Assignee: Yupoong, Inc., Seoul (KR)

( * ) Notice: Subject to any disclaimer, the term of this patent is extended or adjusted under 35 U.S.C. 154(b) by 24 days.

(21) Appl. No.: 10/647,125

(22) Filed: Aug. 25, 2003

(65) Prior Publication Data

US 2005/0120462 A1 Jun. 9, 2005

(51) Int. Cl.
*A42B 1/22* (2006.01)

(52) U.S. Cl. ..... 2/183

(58) Field of Classification Search ..... 2/195.1–195.3, 2/181, 195.6, 195.7, 183, 175.1, 10, 12
See application file for complete search history.

(56) References Cited

U.S. PATENT DOCUMENTS

| | | | | | |
|---|---|---|---|---|---|
| 1,892,515 | A | * | 12/1932 | Lee | 2/181 |
| 2,080,870 | A | * | 5/1937 | Moses et al. | 2/181 |
| 3,465,366 | A | * | 9/1969 | Topiel et al. | 2/183 |
| 5,613,246 | A | * | 3/1997 | Alexander | 2/10 |
| 5,715,540 | A | | 2/1998 | Cho | |
| 5,966,742 | A | * | 10/1999 | Cunliffe | 2/195.3 |
| 5,983,398 | A | * | 11/1999 | Kronenberger | 2/181 |
| 6,052,831 | A | * | 4/2000 | Park | 2/195.2 |
| 6,067,658 | A | | 5/2000 | Cho | |
| 6,115,844 | A | | 9/2000 | Cho | |
| 6,119,273 | A | | 9/2000 | Cho | |
| 6,336,224 | B1 | * | 1/2002 | Wang | 2/195.3 |
| 6,339,844 | B1 | | 1/2002 | Merkley | |
| 6,546,563 | B2 | * | 4/2003 | Young | 2/181 |
| 2003/0106135 | A1 | * | 6/2003 | Landers | 2/195.2 |

* cited by examiner

*Primary Examiner*—Katherine Moran
(74) *Attorney, Agent, or Firm*—Staas & Halsey LLP

(57) ABSTRACT

The present invention is headgear of the billed cap type where the cap can have a fixed size crown. The cap includes an integral two-piece headband or sweatband attached along a bottom of the cap crown on the inside of the crown. The headband includes a first piece, stretchable part located in a front portion of the cap associated with the bill or sun visor and a second piece, non-stretchable part located in the rear. The stretchable part is stretched and attached to the crown in tension along a lower edge, allowing the upper edge of the headband to relax, and incline toward the interior of the crown and away from a sidewall of the crown. This relaxed upper edge is ready to stretch to fit a varying head size while the cap is not distorted by any stretching of the headband. The range of head sizes that can be accommodated by the cap can be increased by providing an elastic visor that is also attached to the cap crown along the bottom peripheral edge of the crown. The extended portion inclines toward the interior of the crown. The visor adds to the range of head sizes accommodated by the headband. The extended portion of the visor can be attached directly to the rear part of the headband substituting for the elastic front part.

21 Claims, 5 Drawing Sheets

HEADGEAR WITH SIZE ACCOMMODATION IN THE FRONT

BACKGROUND OF THE INVENTION

1. Field of the Invention

The present invention is directed to headgear with a variable head size capability, and more specifically to headgear, such as a cap, hat, or sun-visor, that has a fitted appearance, that has the advantage of maintaining a crown shape and that provides a fitted appearance while wearing, while also being capable of accommodating wearers having a range of head sizes, which is accomplished by providing size accommodation in the front of the headgear with a front piece that inclines toward a center of the crown.

2. Description of the Related Art

Generally, there are 3 types of caps in the market: fixed size caps, caps with size adjusting devices and free size caps with stretchable gores and a stretchable sweatband. Fixed-size caps fit only one size of the head of the wearer. Since individual size caps must be made, the cost of producing the caps is high and the resultant costs associated with shipping and storage are also high. This results in increased costs needed to meet the customer's needs. For example, manufacturers typically manufacture a large number of caps for each size and retailers typically stock several lots of caps for each size. On the other hand, size adjustable caps with size adjusting devices typically do not provide wearers with an exact fit and when adjustment is improper, wrinkles are caused in the cap and the shape of cap degrades. Free size caps, which fit a number of head sizes without an adjustment mechanism, usually include a crown portion that includes a stretchable multi-gore shell, a visor portion projecting from the crown and a sweatband connected to the lower peripheral edge of the crown portion. In such free size caps, at least one of the gores of the crown is made of stretchable fabric and the caps include a stretchable sweatband extending along the circumferential direction of the cap so that it is capable of custom fitting all wearers within a predetermined range of head sizes. However, such free size caps lack the ability to support and maintain a predetermined shape of the crown and they suffer from distortion due to the elastic yarn contained in the fabric of the crown and/or sweatband. In addition, the stretchability of the sweatband in the front portion is not as high as that of the sweatband in the rear part due to the stiff visor.

What is needed is a cap that fits a number of head sizes, like a free size cap, but will support and maintain a crown shape so that the crown is not distorted.

SUMMARY OF THE INVENTION

It is an aspect of the present invention to provide a cap that fits a number of head sizes, and supports and maintains a crown shape so that the crown is not distorted.

It is another aspect of the present invention to provide a fitted cap that fits a number of head sizes.

It is a further aspect of the present invention to provide a cap that allows costs of manufacturing, distribution and storage to be reduced.

It is an additional object of the present invention to improve stretchability of the cap in the front.

The above aspects can be attained by headgear of the billed cap type where a two piece headband is provided for the cap attached along a bottom peripheral edge on the inside of a cap crown. The headband includes a stretchable part located in a front portion of the cap associated with the bill or sun visor and a non-stretchable portion located in the rear. The stretchable part is stretched and attached to the crown in tension along a lower edge, allowing the upper edge of the headband to relax and incline toward the interior of the crown. This relaxed upper edge is ready to stretch to fit a varying head size while the cap crown is not distorted by any stretching of the headband. The range of head sizes that can be accommodated by the cap can be increased by providing an elastic visor that is also attached to the cap crown along the bottom peripheral edge of the crown. The visor is attached to the crown producing an extended portion that extends into the crown and inclines toward the interior of the crown. The visor adds to the range of head sizes accommodated by the headband. The extended portion of the visor can be attached directly to the rear part of the headband substituting for the elastic front part.

These together with other aspects and advantages which will be subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
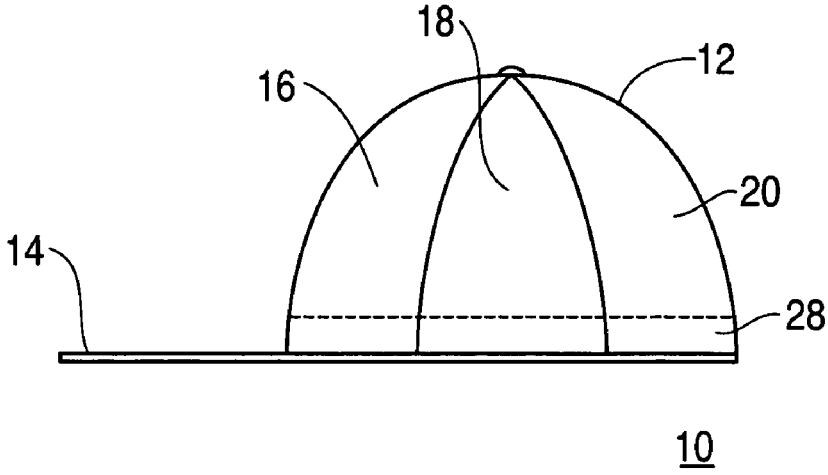
FIG. 1 illustrates major component of a cap according to the present invention.
Figure 2:
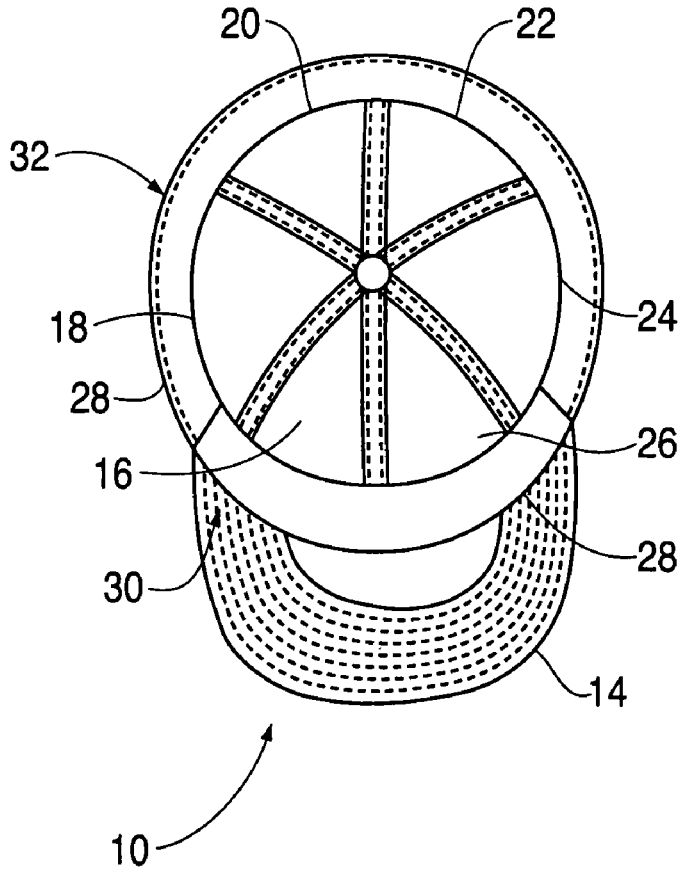
FIG. 2 illustrates the two-piece sweatband component of the cap according to the present invention with additional detail.

The present invention is directed to a fitted style cap 10 with multi-size features as depicted in FIG. 1. The cap 10 includes crown portion 12 for being worn on a head of a wearer, and a visor, bill or sunshield 14 connected to the crown portion 10. As depicted in FIGS. 1 and 2, the crown includes a number of gores 16-26. Each of the gores 16-26 can be made of a stretchable or non-stretchable fabric. The crown 10 may have a fixed size. The cap 10 also includes a headband or sweatband 28 attached inside the cap 10 along a lower peripheral edge of the crown 12 as shown generally by a dashed line in FIG. 1 and shown in two parts in FIG. 2.

Figure 9:
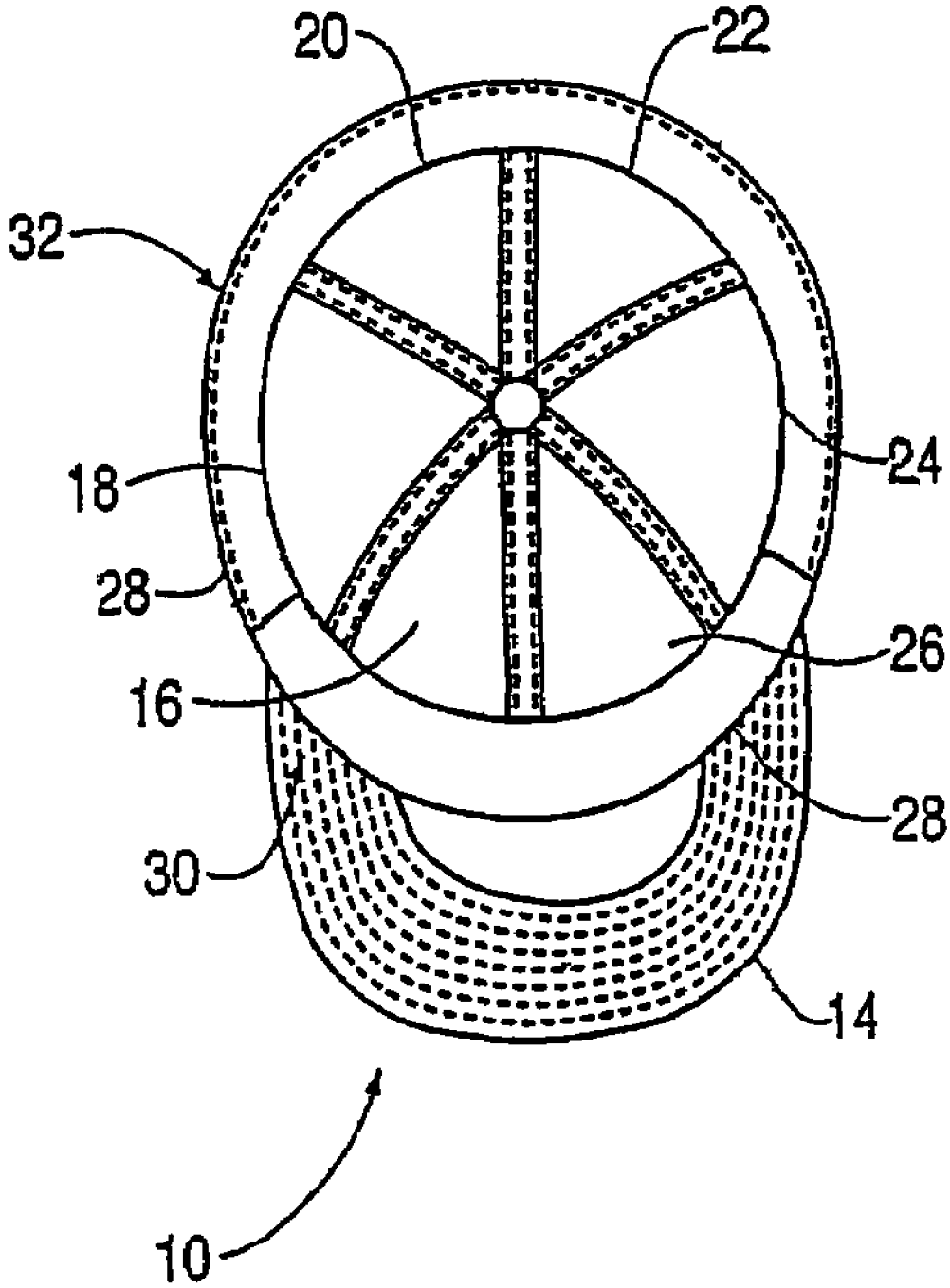
FIG. 9 illustrates the two-piece sweatband component of the cap according to the embodiment of the present invention.

As noted above the sweatband 28 is preferably of a two-part construction where the sweatband has a front part 30 and a rear part 32. The cap of FIG. 2 shows the front part 30 extending circumferentially around the edge of the gores 16 of the crown portion 10 and preferably defined by the edges of the visor 14 and the bottom edges of the gores 16. It is possible for the front part to extend beyond the edges of the visor 14 and extend past not only gores 16 and 26 but also gores 18 and 24 (see FIG. 9). The front part 30 of the sweatband 28 connected to the visor portion of the crown is made of a stretchable fabric, preferably stretchable along a length of the headband 28 where sweatband material that is uni-axially as well as bi-axially stretchable can be used. The rear part 32 of the sweatband 28 is preferably made of a fabric that is essentially not stretchable.

Figure 3:
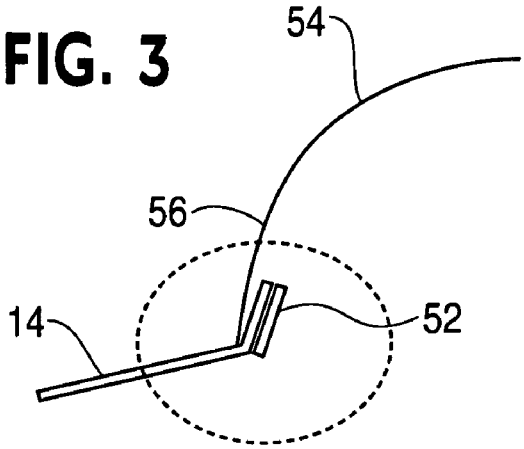
FIGS. 3 and 4 depict features of a typical cap.
Figure 4:
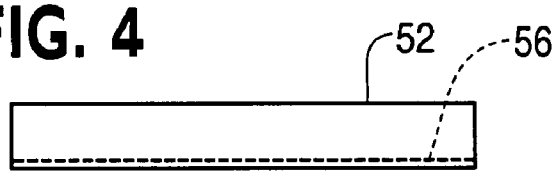

A typical sweatband 52 for a cap crown 54, as depicted in FIG. 3, is attached or sewn to the crown 54 along a bottom edge and sometimes sewn to an inside folded part of the crown 54. This results in a generally straight stitching or sewing line 56 along the bottom of the sweatband 52 as depicted in FIG. 4. The sweatband 52 when looked at from inside the cap has a generally straight appearance in that the length along the top edge of the sweatband 52 is the same as the length along the bottom edge. This allows the width of the sweatband 52 to generally extended upward inside the crown 54 generally parallel with a sidewall 56 of the crown 54 as shown in FIG. 3.

Figure 5:
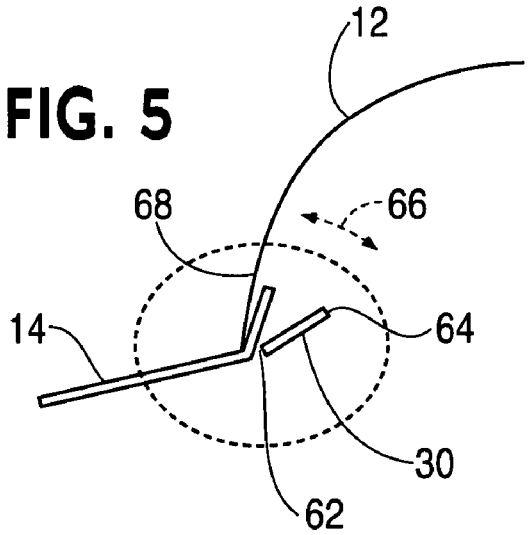
FIGS. 5 and 6 depict additional features of the cap of the present invention.
Figure 6:
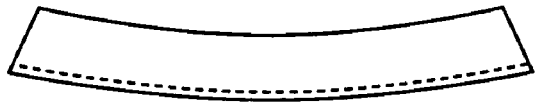

In the present invention, when the front part 30 of the sweatband 28 is attached to the crown 12, as depicted in FIG. 5, the lower part 62 of the front part 30 of the sweatband 28 is stretched in a circumferential direction of the crown 12 and sewn to the crown 12 generally along the bottom peripheral edge of the front of the crown 12. This stretching and sewing along the bottom edge fixes the length of the front part 30 along the bottom peripheral edge of the crown 12 in a condition of stretched tension but allows the length along the top edge of the sweatband 28 to relax or not be in tension giving the front part 30 a somewhat curved appearance as depicted in FIG. 6. The top edge of the front part 30 is generally at least in less tension than the bottom edge. This stretching of the bottom edge and contraction of the top edge causes the upper part 64 of the headband 28 to incline toward the center of the crown 12 (see FIG. 5). This inclined angle 66 formed between the front part 30 of the sweatband 28 and a sidewall 68 of the crown 12, allowing the top edge of the sweatband to relax along with the stretchability of the front part 30, makes the cap accommodate various head sizes. The relaxed upper edge of the sweatband 28 is ready to stretch to fit various head sizes.

Figure 7:
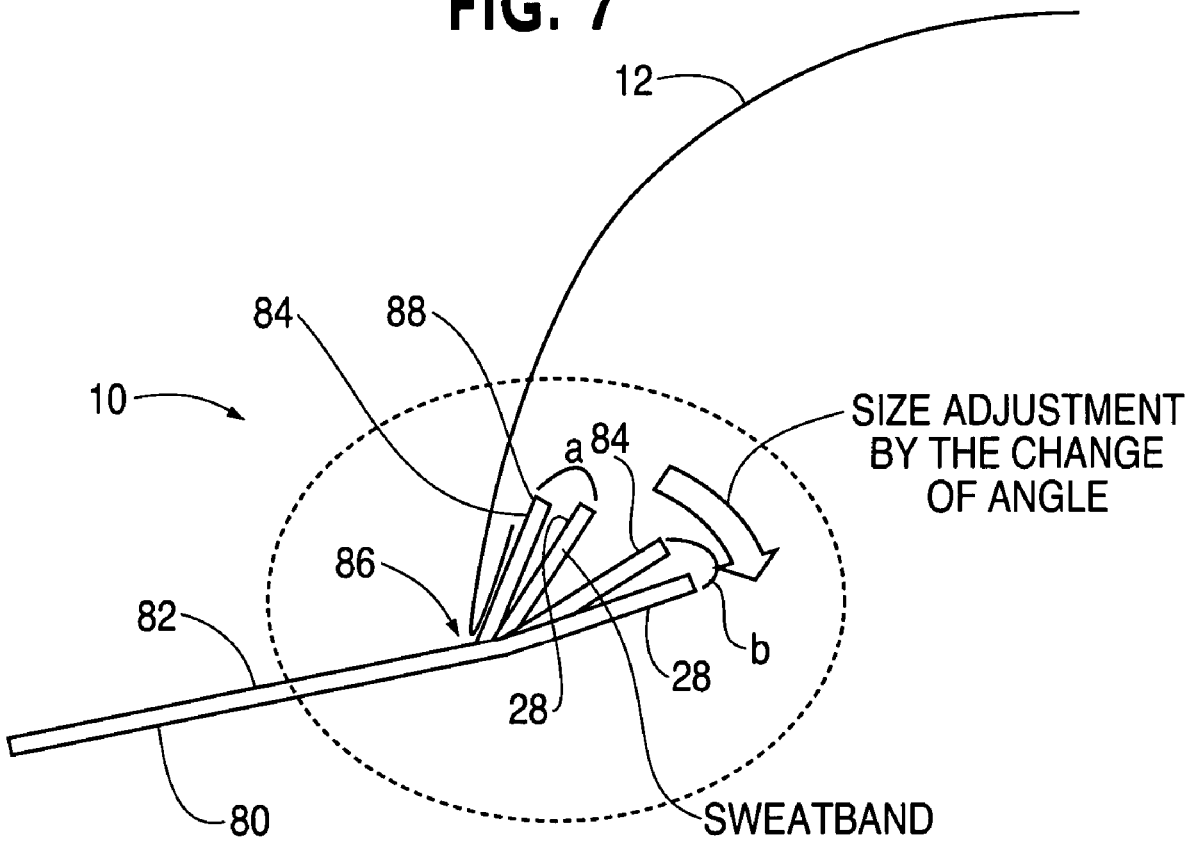
FIGS. 7 and 8 depict another embodiment of the present invention where the visor is elastic and extends into an interior of the cap.

In another preferred embodiment of this invention as depicted in FIG. 7, the cap 10 has an elastic visor 80 having a bill 82 and an integral extended visor portion 84. The extended portion 84 has an exterior edge 86 attached to the crown 12 inside the crown 12 along the bottom peripheral edge of the crown 12 and an interior edge 88 of the extended portion 84 that extends toward the interior of the crown 12. Because the elastic visor 80 is sewn inside the crown (before the headband 28 is attached to the crown 12), the extended portion 84 of the visor 80 is caused to incline toward the interior of the crown 12. Therefore, elasticity of the extended visor portion 84 helps the sweatband 28 incline toward the interior of the crown 12 so that it increases fitted feeling to the wearers. For example, when the cap 10 is worn by a wearer with a bigger head size, the extended visor portion 84 and sweatband 28 would be in positions denoted by (a) in the FIG. 7 and the extended visor portion 84 adds more elasticity onto the stretchable front part of the sweatband 28 and gives fitted feeling to the wearers. On the other hand, when the cap 10 is worn by a wearer with a smaller size head, the extended visor portion 84 and sweatband 28 would be in relative positions denoted by (b) in FIG. 7 and the extended visor portion 84 helps sweatband 28 maintain the inclined position and gives an improved fitted feeling to the wearers.

Figure 8:
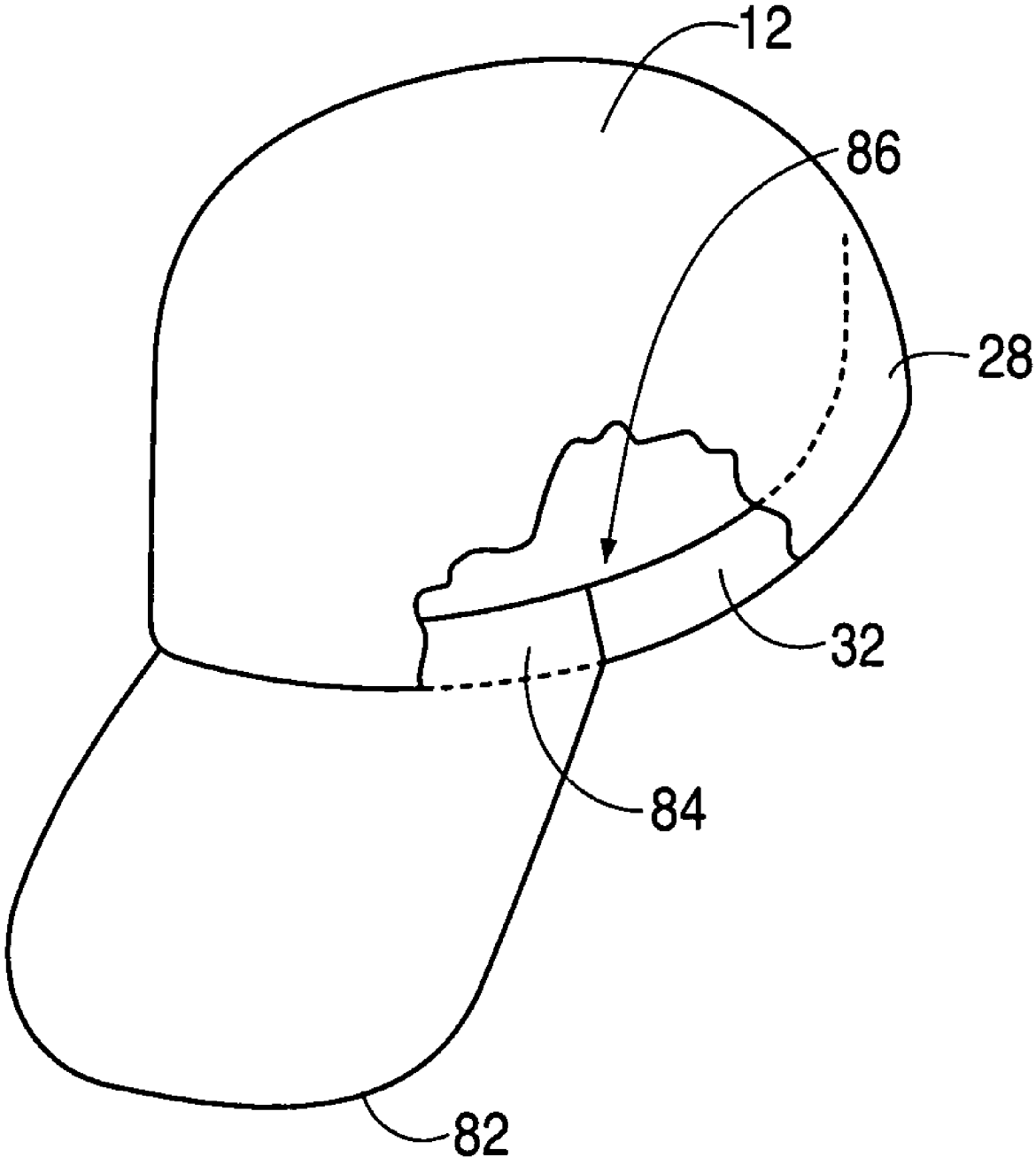

In a further embodiment as depicted in the cutaway view of FIG. 8, the extended portion 84 of the elastic visor 82 along the edges (see edge 86) is attached directly to the rear part 32 of the headband 28 so that the sweatband in the front part is not necessary. That is, the extended portion 84 substitutes for the elastic sweatband. The extended portion 84 inclines toward the center of the crown 12 allowing the extended portion 84 of the elastic visor 82 to stretch to accommodate a range of head sizes.

In accordance with the present invention, the size adjustment function or capability of the cap 10 comes from the front part 30 of the sweatband 28 and/or the extended portion 84 of the visor unlike other free size caps that have the stretchability in rear part of the crown or sweatband.

A very important feature of present invention is that the cap has the advantage of a fitted cap to give the custom fitted appearance and also has the advantage of the free size cap to cover several head sizes.

The present invention has been described with respect to a cap having a crown. The invention can also be included in a visor, a hat with circumferential brim, etc.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. Headgear, comprising:

a cap having a crown and a visor; and a headband attached to the crown and comprising a front part formed of stretchable fabric and a rear part, behind the front part in a circumferential direction of the headband, formed of a non-stretchable fabric, the front part being closer to the visor than the rear part, the front part and the rear part forming a continuous loop, and respective ends of the front and rear parts abutting each other, a portion of the front part being 180 degrees opposite to a portion of the rear part along a circumference of the loop.

2. Headgear as recited in claim 1, wherein the front part of the headband comprises a bottom edge in stitched contact with the crown and in tension.

3. Headgear as recited in claim 1, wherein a lower portion of the front part of the headband is attached to the crown in tension, the tension of the lower portion of the front part of the headband being greater than a tension of a top portion of the front part of the headband so that the front part of the headband inclines toward a center of the crown.

4. Headgear as recited in claim 1, wherein the front part of the headband extends circumferentially in the crown along the bottom to edges of the visor.

5. Headgear as recited in claim 1, wherein the front part of the headband extends circumferentially in the crown along a bottom of the crown beyond edges of the visor.

6. Headgear as recited in claim 1, wherein the front part of the headband is stretched and sewn to the crown along a bottom peripheral edge of the crown and a bottom edge of the front part.

7. Headgear as recited in claim 1 wherein the crown is a fixed size.

8. Headgear as recited in claim 1, wherein the visor is elastic and comprises:

a bill extending outside the crown; and an extended portion extending into the crown.

9. Headgear, comprising:

a cap having a fixed size crown and a visor attached to the crown; and a sweatband attached to a circumference of the crown, said sweatband comprising:

a front part formed of stretchable fabric stretchable in a length direction of the sweatband, the front part inclining toward a center of the crown away from a crown side wall and comprising a bottom edge sewn to a peripheral edge of the crown in tension and a top edge not attached to the crown and not in tension; and a rear part, behind the front part in a circumferential direction of the sweatband, formed of a non-stretchable fabric, the front part and the rear part forming a continuous loop and the front part being closer to the visor than the rear part, respective ends of the front and rear parts abutting each other, a portion of the front part being 180 degrees opposite to a portion of the rear part along a circumference of the loop.

10. Headgear, comprising:

a cap having a crown and a elastic visor attached to a circumference of the crown and having an extended portion extending into an interior of the crown; and a sweatband attached to the crown through the extended portion, said sweatband comprising:

a front part formed of stretchable fabric of the sweatband, inclining toward a center of the crown away from a crown side wall and comprising a bottom edge sewn to a peripheral edge of the crown in tension and a top edge not attached to the crown and not in tension; and a rear part, behind the front part in a circumferential direction of the sweatband, formed of a non-stretchable fabric, the front part and the rear part forming a continuous loop, the front part being closer to the visor than the rear part and respective ends of the front and rear parts abutting each other, a portion of the front part being 180 degrees opposite to a portion of the rear part along a circumference of the loop.

11. Headgear, comprising:

a visor;

a headband attached to the visor and comprising a front part formed of stretchable fabric and a rear part, behind the front part in a circumferential direction of the headband, formed of a non-stretchable fabric, the front part and the rear part forming a continuous loop; and a crown;

wherein the front part of the headband extends circumferentially in the crown and the front part being closer to the visor than the rear part and respective ends of the front and rear parts abutting each other, a portion of the front part being 180 degrees opposite to a portion of the rear part along a circumference of the loop.

12. Headgear as recited in claim 11, wherein the front part of the headband comprises a bottom edge attached to the crown in tension.

13. Headgear as recited in claim 11, wherein a lower portion of the front part of the headband is attached to the crown in tension, the tension of the lower portion of the front part of the headband being greater than a tension of a top portion of the front part of the headband so that the front part of the headband inclines toward a center of the crown.

14. Headgear as recited in claim 11, wherein the front part of the headband extends circumferentially in the crown along the bottom to edges of the visor.

15. Headgear as recited in claim 11, wherein the front part of the headband extends circumferentially in the crown along the bottom beyond edges of the visor.

16. Headgear as recited in claim 11, wherein the front part of the headband is stretched and sewn to the crown along a bottom peripheral edge of the crown and a bottom edge of the front part.

17. Headgear as recited in claim 11, wherein the sunshield is elastic and comprises:

a bill extending outside the headband; and an extended portion extending inside the headband.

18. A method of making a headgear, comprising:

sewing a visor to a crown;

forming a headband having a front part which is stretchable and a rear part which is non-stretchable, the front part and the rear part forming a continuous loop; and stretching the stretchable part of the headband and attaching the headband to the crown along a bottom edge of the crown and a bottom edge of the headband, the front part being closer to the visor than the rear part, and respective ends of the front and rear parts abutting each other, a portion of the front part being 180 degrees opposite to a portion of the rear part along a circumference of the loop.

19. A method as recited in claim 18, wherein the visor is elastic and the method further comprising attaching the visor to the crown before the headband is attached to the crown and producing an extended portion of the elastic visor extending into an interior of the crown.

20. A method of making a headgear, comprising:

sewing an elastic visor to a crown with an extended portion extending into an interior of the crown;

forming a headband having a rear part which is non-stretchable and a front part which is stretchable, the front part and the rear part forming a continuous loop; and attaching the headband to the crown along a bottom edge of the crown and to the extended portion of the elastic visor, the front part being closer to the visor than the rear part and respective ends of the front and rear parts abutting each other, a portion of the front part being 180 degrees opposite to a portion of the rear part along a circumference of the loop.

21. Headgear, comprising:

a cap having a crown and an elastic visor attached to the crown extending into the crown; and a headband attached to the crown and comprising a rear part formed of a non-stretchable fabric and a front part formed of a stretchable fabric, and attached to the visor, the front part and the rear part forming a continuous loop, the front part being closer to the visor than the rear part and respective ends of the front and rear parts abutting each other, a portion of the front part being 180 degrees opposite to a portion of the rear part along a circumference of the loop.

* * * * *